US011545730B2

(12) United States Patent
Hu et al.

(10) Patent No.: US 11,545,730 B2
(45) Date of Patent: Jan. 3, 2023

(54) ANTENNA DEVICE AND METHOD FOR MANUFACTURING ANTENNA DEVICE

(71) Applicant: SHUNSIN TECHNOLOGY (ZHONG SHAN) LIMITED, Zhongshan (CN)

(72) Inventors: Jian-Wen Hu, Zhongshan (CN); Hong-Guang Huang, Shenzhen (CN); Shun-Long Lee, New Taipei (TW)

(73) Assignee: SHUNSIN TECHNOLOGY (ZHONG SHAN) LIMITED, Zhongshan (CN)

( * ) Notice: Subject to any disclaimer, the term of this patent is extended or adjusted under 35 U.S.C. 154(b) by 46 days.

(21) Appl. No.: 17/370,133

(22) Filed: Jul. 8, 2021

(65) Prior Publication Data

US 2022/0077558 A1 Mar. 10, 2022

(30) Foreign Application Priority Data

Sep. 7, 2020 (CN) ..... 202010928659.9

(51) Int. Cl.
*H01P 5/18* (2006.01)
*H01Q 1/12* (2006.01)
*H01Q 1/50* (2006.01)

(52) U.S. Cl.
CPC ..... *H01P 5/18* (2013.01); *H01Q 1/12* (2013.01); *H01Q 1/50* (2013.01)

(58) Field of Classification Search
CPC ..... H01Q 1/12; H01Q 1/2283; H01Q 1/241; H01Q 1/38; H01Q 9/0414; H01P 5/18
See application file for complete search history.

(56) References Cited

U.S. PATENT DOCUMENTS 10,056,922 B1 * 8/2018 Tsvelykh ..... H01P 1/20345
2014/0375395 A1 * 12/2014 Suga ..... H01P 11/003 333/116
2018/0261566 A1 9/2018 Babcock et al.
2019/0279950 A1 * 9/2019 Kim ..... H01Q 1/2283
2021/0384609 A1 * 12/2021 An ..... H01Q 1/2283
2022/0077558 A1 * 3/2022 Hu ..... H01Q 1/002

FOREIGN PATENT DOCUMENTS

CN 110233357 A 9/2019

* cited by examiner

*Primary Examiner* — Jason Crawford
(74) *Attorney, Agent, or Firm* — ScienBiziP, P.C.

(57) ABSTRACT

An antenna device with high component-density but enhanced means of dissipating working heat includes a metal substrate of a wireless device, a coupler, a filter, a conductive layer, and an antenna element. The coupler is disposed on one side of the metal substrate, the metal substrate serving as a heat sink. The filter is disposed on the coupler. The conductive layer covers the coupler and is electrically connected to the filter and ground. The antenna element is disposed on the other side of the metal substrate relative to the coupler, passes through the metal substrate and is electrically connected to the coupler and the filter. A method for manufacturing the antenna device is also disclosed.

11 Claims, 3 Drawing Sheets

ANTENNA DEVICE AND METHOD FOR MANUFACTURING ANTENNA DEVICE

FIELD

The subject matter herein generally relates to wireless communications, antenna devices, and methods for manufacturing antenna devices.

BACKGROUND 5G communication systems are implemented in a high frequency (millimeter wave) band, such as the 60 GHz band, in order to achieve higher data rates. In order to provide small size, low cost, light weight and avoid unnecessary power loss, the antenna integrates numerous active modules inside the antenna to realize the functions of a part of the base station, especially the power amplifier module. However, with such a large-scale and high-density design, the heat dissipation is poor.

BRIEF DESCRIPTION OF THE DRAWINGS

Implementations of the present disclosure will now be described with reference to the attached figures.

DETAILED DESCRIPTION

Figure 1:
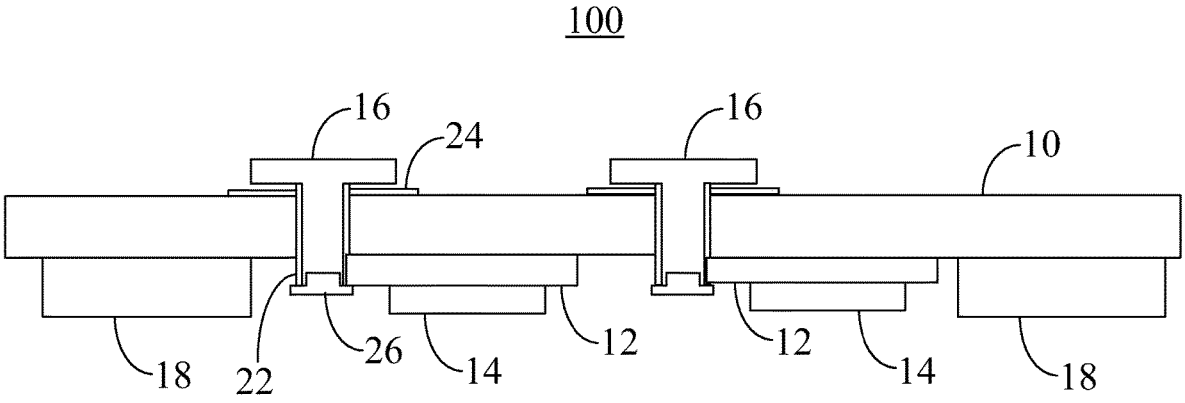
FIG. 1 is a cross-sectional view of an antenna device according to an exemplary embodiment of the disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure. The disclosure is illustrated by way of example and not by way of limitation in the figures of the accompanying drawings, in which like references indicate similar elements. It should be noted that references to "an" or "one" embodiment in this disclosure are not necessarily to the same embodiment, and such references mean "at least one."

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series, and the like.

The embodiments herein provide many applicable inventive concepts that can be embodied in a variety of specific methods. The specific embodiments discussed are merely illustrative of specific methods to make and use the embodiments, and do not limit the scope of the disclosure. In addition, the disclosure may repeat reference numbers and/or letters in the various embodiments. This repetition is for the purpose of simplicity and clarity, and does not imply any relationship between the different embodiments and/or configurations discussed. Furthermore, when a first material layer is referred to as being on or overlying a second material layer, the first material layer may be in direct contact with the second material layer, or spaced apart from the second material layer by intervening layers.

FIG. 1 shows a cross-sectional view of the antenna device according to an exemplary embodiment of the disclosure. The antenna device 100 according to an exemplary embodiment of the disclosure comprises a metal substrate 10, a coupler 12, a filter 14, an antenna element 16, and a physical layer 18. The coupler 12 is disposed on one side of the metal substrate 10 (on the bottom side as seen in FIG. 1), and the filter 14 is disposed on the surface of the coupler 12 away from the metal substrate 10. The antenna element 16 is disposed on the other side of the metal substrate 10 relative to the coupler 12 (on the top side in FIG. 1), passes through the via hole of the metal substrate 10 to electrically connect to the coupler 12 and the filter 14 through conductors such as wires, metal sheets or gold wires.

The physical layer 18 is disposed on the metal substrate 10 and is located on the same side as the coupler 12. In addition, the metal substrate 10 has insulating layers 22 and 24 on the sidewalls and the top of the via hole for mounting the antenna element 16. According to an embodiment of the disclosure, the insulating layer 22 can be an insulating plastic sleeve, and the insulating layer 24 may be a printed insulating material. The screw 26 is used to lock the antenna element 16.

The metal substrate 10 serves as a reflector of the antenna. The coupler 12 can be a power divider or a directional coupler. According to an embodiment of the disclosure, the power divider may be in a transmission line type or a waveguide type. The transmission line type power divider can be a Wilkinson power divider, a hybrid coupler, a hybrid ring coupler, or a multi-output frequency divider, etc. The power divider divides the signal into two signals, and divides the signal power approximately equally between its two output terminals. The directional coupler can be a branch line coupler, a Lange coupler, a waveguide branch line coupler, a Bethe-hole directional coupler, a Riblet short-slot waveguide coupler, a Schwinger reversed-phase coupler, or a Moreno cross-guide coupler, etc.

The antenna element 16 is used to send and receive wireless signals. The physical layer 18 comprises resistors, capacitors, inductors, low noise amplifiers, mixers, digital signal processors, duplexers, line drivers, optical transceivers, wireless sensors, power bias generators, control circuits, phased array circuits, analog-to-digital or digital-to-analog converters, storage devices, transformers, transmission lines, waveguide devices or other functional modules. According to the embodiment of the disclosure, the physical layer 18 is directly mounted on the metal substrate 10, so the metal substrate 10 acts to collect heat, improving the heat dissipation efficiency.

According to the embodiment of the disclosure, the antenna element 16 transmits and receives RF signals by the control of the control circuit in physical layer 18 according to the IEEE16.11 standard (including IEEE16.11a, b, or g) or the IEEE802.11 standard (including IEEE 802.11a, b, g, n). In other embodiments, the antenna element 16 transmits and receives BLUETOOTH RF signals. The antenna element 16 can be designed to receive signals of code division multiple access (CDMA), frequency division multiple access (FDMA), time division multiple access (TDMA), global system for mobile communications (GSM), general packet radio service (GPRS), enhanced Data GSM environment (EDGE), Terrestrial Trunked Radio (TETRA), Wideband Code Division Multiple Access (WCDMA), Evolution-Data Optimized (EV-DO), high-speed Packet Access (HSPA), High Speed Downlink Packet Access (HSDPA), High Speed Uplink Packet Access (HSUPA), Evolved High Speed Packet Access (HSPA+), Long Term Evolution (LTE), or other known signals communicated in wireless networks (such as systems using 3G or 4G technology).

According to the embodiment of the disclosure, the control circuit may be a wireless communication chip, such as a radio frequency integrated circuit (RFIC) or a monolithic microwave integrated circuit (MMIC), which can support, for example, Near Field Communication (NFC), radio frequency identification (RFID), BLUETOOTH, BLUETOOTH Low Energy (BLE), Zigbee, IEEE 802.11, BEACON, Internet Protocol (IP), Transmission Control Protocol (TCP), User Data Packet Communication Protocol (UDP), Device-to-Device (D2D) Protocol, Long-Term Evolution Direct (LTE-D), Narrowband Internet of Things (NB-IoT), LTE CAT-M, vehicle to X (V2X) or other protocols, or communication chips supporting 3G, 4G, or 5G.

In other embodiments, the chip 16 can be integrated circuits such as active or passive elements, digital circuits or analog circuits, such as optoelectronic devices, micro-electromechanical systems (MEMS), power amplifier chips, power management chips, biometric devices, microfluidic systems, or physical sensors. The physical sensors can be image sensors, light-emitting diodes (LEDs), solar cells (solar cells), accelerometers, and gyroscopes, fingerprint readers, micro actuators, surface acoustic wave devices, pressure sensors, or ink printer heads.

Figure 2:
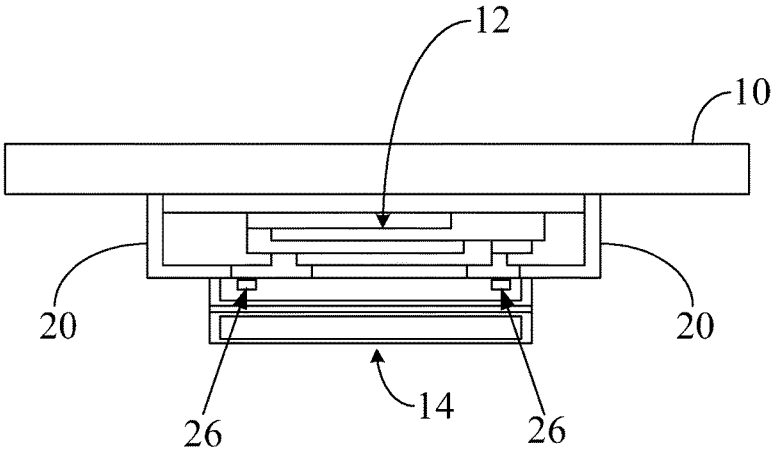
FIG. 2 is an enlarged cross-sectional schematic diagram of a coupler and a filter according to an embodiment of the disclosure.

FIG. 2 shows an enlarged diagram of the coupler 12 and the filter 14 according to an embodiment of the disclosure. The coupler 12 is disposed on one side of the metal substrate 10 (the bottom side in FIG. 2). The coupler 12 has a multilayer structure, including dielectric layers, inner connection layers, and circuit layers. The circuits of the power divider and the directional coupler can be arranged in the multilayer structure of the coupler 12. The cross-sectional structures of the coupler 12 and the filter 14 shown in FIG. 2 are only examples, and the actual layout can be adjusted by those skilled in the art according to actual circuit requirements.

The outer side of the coupler 12 is covered with a conductive layer 20. According to an embodiment of the disclosure, the material of the conductive layer 20 is silver ink, which is printed on and to cover the side surface of the coupler 12. Next, the filter 14 is disposed on the conductive layer 20. The electrical contact 28 of the filter 14 can be electrically connected to the coupler 12 through a conductor, eliminating the need for a soldering process. The conductive layer 20 can also be electrically connected to the ground lines of the filter 14 and the metal substrate 10 to improve shielding against electromagnetic interference.

Figure 3A:
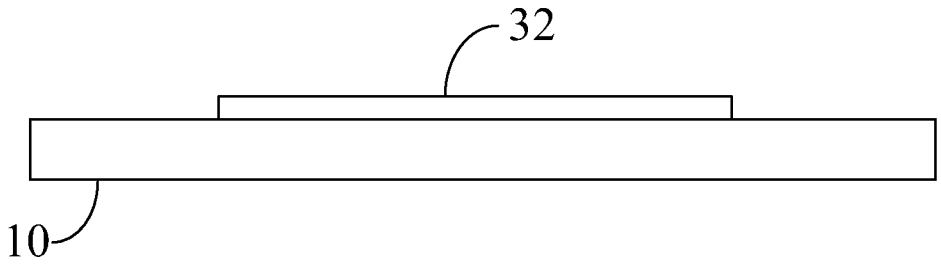
FIGS. 3A to 3D are cross-sectional views of an antenna device formed according to an exemplary method of the disclosure.

FIGS. 3A to 3D shows the stages of a method for forming the antenna device according to an exemplary embodiment of the disclosure. For the convenience of description, the structures shown in FIGS. 3A to 3D are opposite to the direction displayed in FIG. 1. Referring to FIG. 3A, a metal substrate 10 is provided, and a dielectric layer 32 is formed on the metal substrate 10 using a screen printing method. According to an embodiment, the dielectric layer 32 may be composed of oxide, such as silicon oxide (SiOx). In some other embodiments, the dielectric layer 32 is composed of a polymer, such as benzocyclobutene (BCB) polymer, polyimide (PI), or polybenzoxazole (PBO).

Figure 3B:
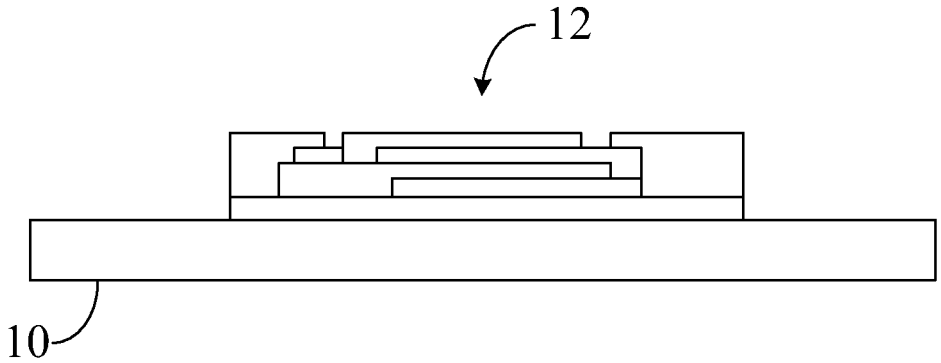

Referring to FIG. 3B, the metal layer, the diffusion barrier layer and the dielectric layer in the structure of the coupler 12 are formed through a deposition process, such as chemical vapor deposition (CVD), physical vapor deposition (PVD), or other applicable process.

Next, a photoresist (PR) layer is formed, and then the photoresist layer is patterned by a patterning process to expose a part of the metal layer. The patterning process includes a lithography process and an etching process. Examples of the lithography process include soft baking, mask alignment, exposure, post-exposure baking, photoresist development, rinsing, and drying (such as hard baking). The etching process can be a dry etching or a wet etching process. According to an embodiment, the metal layer is composed of conductive materials, such as titanium, copper, tin, aluminum, nickel, silver, gold, or alloys. In some embodiments, the first metal layer can be formed through an electroplating process or other applicable process. After the steps of inner conductor printing, inner multilayer interconnection, and I/O circuit printing, the coupler 12 is formed.

The process for forming a multilayer structure on a substrate is well known to those skilled in the art, and is not repeated here. As mentioned, the power divider and the circuit of the directional coupler can be arranged in the multi-layer structure of the coupler 12. Furthermore, the structure of the coupler 12 shown in FIG. 3B is only an example, and the actual layout can be adjusted by those skilled in the art according to actual circuit requirements.

Figure 3C:
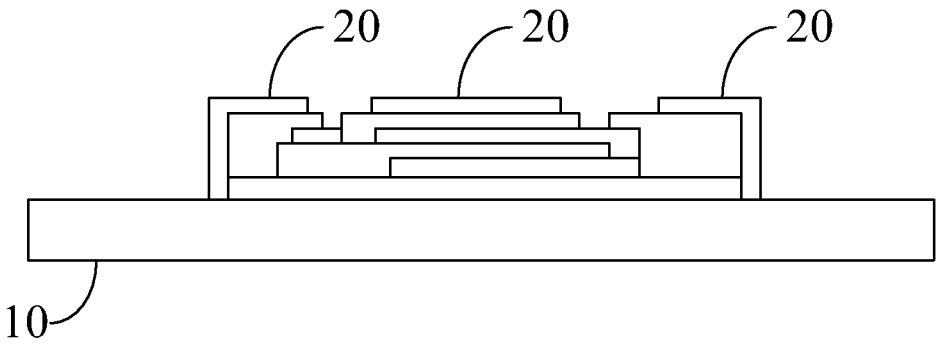

Referring to FIG. 3C, a conductive layer 20 is formed on the outside of the coupler 12 by screen printing. According to an embodiment of the disclosure, the material of the conductive layer 20 can be silver ink, which is printed on and covers the side surface and the top surface of the coupler 12. Since the curing temperature of silver ink is lower than that of tin, the tempering procedure is omitted, and complexity of the process is simplified. The silver ink being implemented in a lower temperature environment results in better product reliability.

Figure 3D:
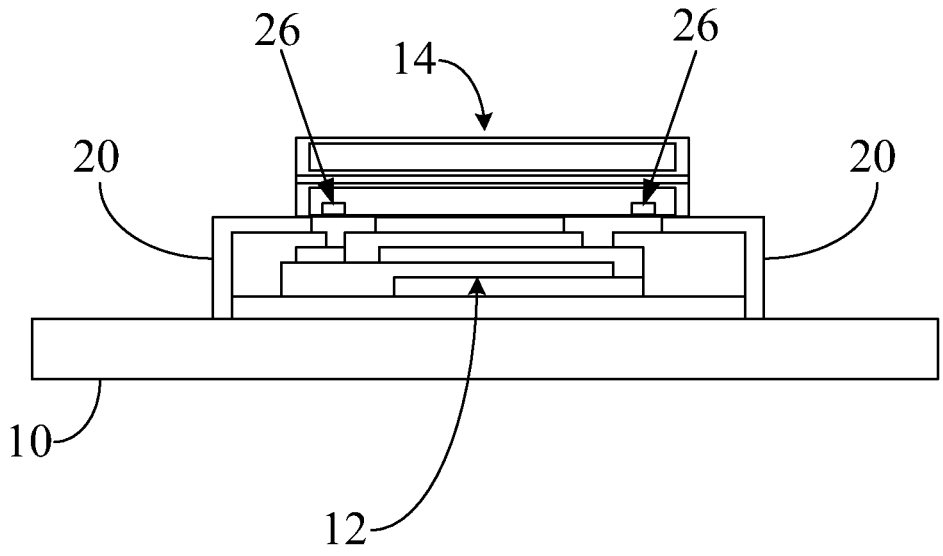

Next, referring to FIG. 3D, the filter 14 is disposed on the conductive layer 20. The electrical contact 28 of the filter 14 can be electrically connected to the coupler 12 through a conductor, eliminating the need for a soldering process. The conductive layer 20 can also be electrically connected to the ground lines of the filter 14 and the metal substrate 10 to improve electromagnetic interference shielding.

According to the method for manufacturing the provided by the embodiments of the disclosure, a silver conductor is printed using printing technology to cover the coupler 12, and the silver conductor is connected to the ground of the metal substrate, improving electromagnetic interference shielding. Furthermore, the physical layer of the antenna is directly mounted on the metal substrate, and the metal substrate enhances heat dissipation, improving the heat dissipation efficiency. In addition, the physical layer and the coupler are disposed on the same side of the metal substrate, which reduces the complexity of the circuit layout.

Many details are often found in the relevant art, thus many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna device comprising:

a metal substrate;

a coupler disposed on one side of the metal substrate;

a filter disposed on the coupler;

a conductive layer covering the coupler and coupled to the filter and ground; and an antenna element disposed on the other side of the metal substrate relative to the coupler, passing through the metal substrate and electrically connected to the coupler and the filter.

2. The antenna device of claim 1, further comprising a physical layer disposed on the one side of the metal substrate, and coupled to the antenna element.

3. The antenna device of claim 1, wherein the coupler is a power divider or a directional coupler.

4. The antenna device of claim 1, wherein the conductive layer is silver ink.

5. The antenna device of claim 1, wherein the filter and the coupler are disposed on the one side of the metal substrate.

6. A method for manufacturing an antenna device comprising:

providing a metal substrate;

disposing a coupler on one side of the metal substrate;

disposing a filter on the coupler;

disposing a conductive layer covering the coupler and coupled to the filter and ground; and disposing an antenna element on the other side of the metal substrate relative to the coupler, wherein the antenna element passes through the metal substrate and is electrically connected to the coupler and the filter.

7. The method of claim 6, further comprising disposing a physical layer on the one side of the metal substrate, and coupled to the antenna element.

8. The method of claim 6, wherein the coupler is a power divider or a directional coupler.

9. The method of claim 6, wherein the filter and the coupler are disposed on the one side of the metal substrate.

10. The method of claim 6, wherein the conductive layer is silver ink.

11. The method of claim 6, wherein the silver ink is formed by printing.

* * * * *